United States Patent [19]

Schuette

[11] 4,296,577

[45] Oct. 27, 1981

[54] HELICAL STAIRCASE SUPPORT

[76] Inventor: Heinz G. Schuette, 26145 Shook, Mt. Clemens, Mich. 48045

[21] Appl. No.: 87,040

[22] Filed: Oct. 22, 1979

[51] Int. Cl.[3] ..... E04F 11/00

[52] U.S. Cl. ..... 52/187; 248/282

[58] Field of Search ..... 52/182, 183, 187; 248/282, 276, 284; 403/62

[56] References Cited

U.S. PATENT DOCUMENTS

| | | | |
|---|---|---|---|
| 1,774,582 | 9/1930 | Woodbridge . | |
| 2,164,390 | 7/1939 | Dickerson | 248/282 |
| 3,207,259 | 9/1965 | Gebhart | 182/93 |
| 3,213,579 | 10/1965 | Neher | 52/187 |
| 3,430,729 | 3/1969 | Miceli | 182/93 |
| 3,473,275 | 10/1969 | Lappin, Jr. | 52/187 |
| 3,482,364 | 12/1969 | Albrektson et al. | 52/187 |
| 3,916,591 | 11/1975 | Agterhof et al. | 52/187 |
| 4,125,175 | 11/1978 | Ernst | 52/182 X |

FOREIGN PATENT DOCUMENTS

| | | | |
|---|---|---|---|
| 2256370 | 5/1974 | Fed. Rep. of Germany | 52/182 |
| 2552220 | 6/1977 | Fed. Rep. of Germany | 52/187 |

*Primary Examiner*—Carl D. Friedman

*Attorney, Agent, or Firm*—Basile, Weintraub & Hanlon

[57] ABSTRACT

A staircase support for a flying staircase of helical construction requiring attachment to the dwelling only at an upper and lower end thereof is disclosed. The support comprises a bracket including a first vertical tube and a second vertical tube axially spaced from the first tube and a horizontal member which extends from an upper portion of the first tube to a lower portion of the second tube. A plurality of identical brackets are assembled with a first bracket second tube upper end abutting a second bracket first tube lower end. In a preferred embodiment an expandable sleeve slidingly engages the abutting tubes and is expanded to fixedly engage adjacent brackets.

6 Claims, 5 Drawing Figures

FIG-1
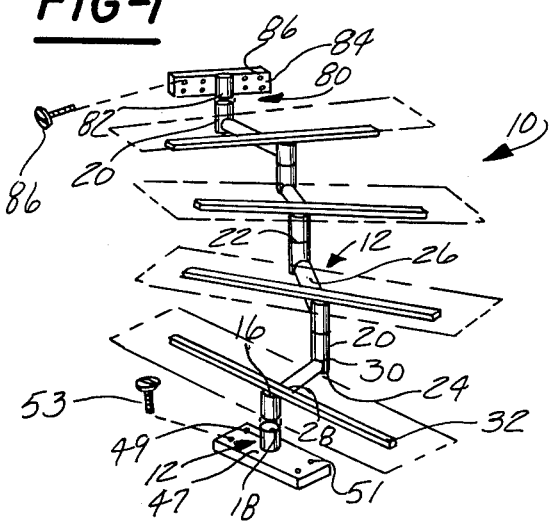
FIG-2
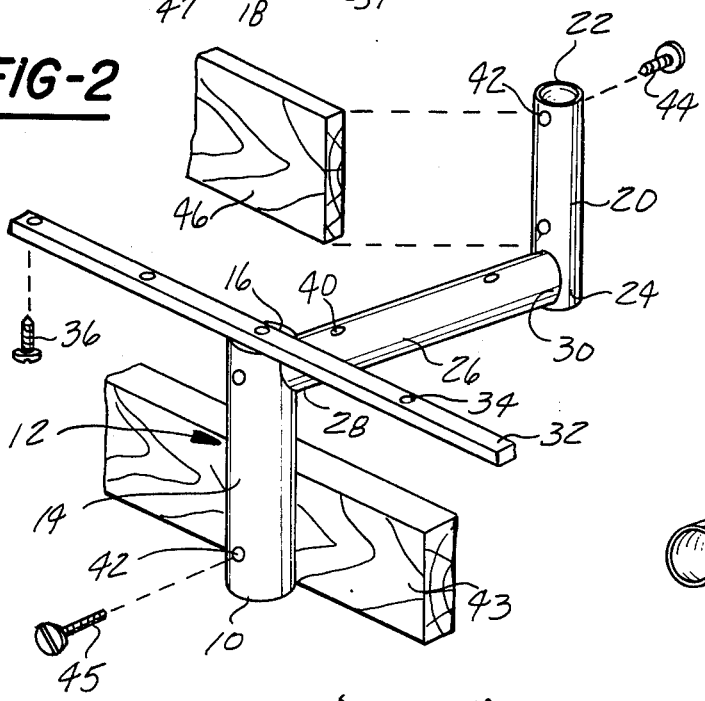
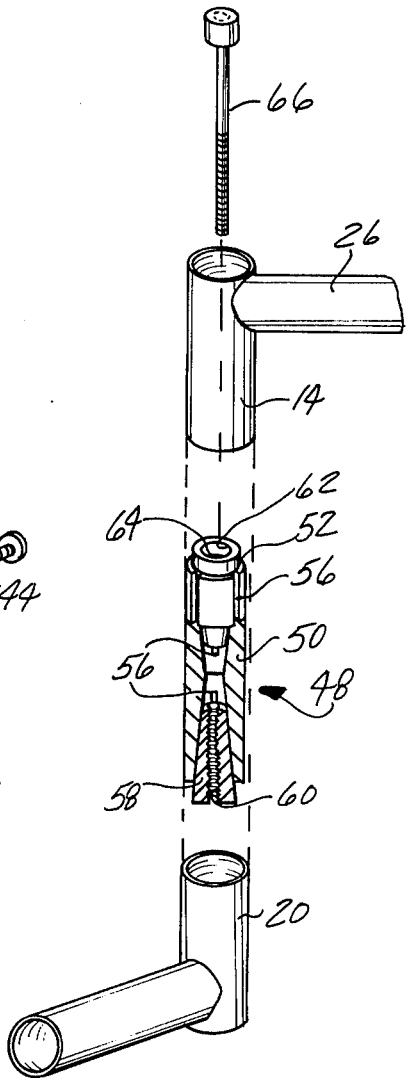
FIG-3
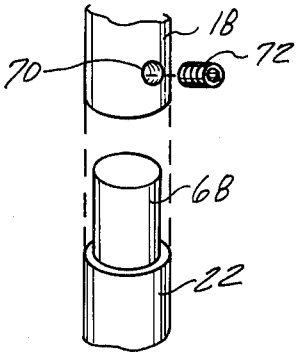
FIG-5

HELICAL STAIRCASE SUPPORT

BACKGROUND OF THE INVENTION

I. Field of the Invention

The present invention generally relates to helical staircases, and in particular, the present invention is concerned with a flying helical staircase supported only at an upper and lower end thereof. Even more particularly the present invention is concerned with a support for a flying helical staircase, with the support being adjustable providing for varying and/or reversible helical radii, as well as a combination curves of varying and/or reversing radius combined with straight sections.

II. Description of the Prior Art

Spiral or helical staircases have long been known. Examples of helical staircases in the prior art are disclosed in U.S. Pat. Nos. 1,774,582; 3,207,259; 3,213,579; 3,430,729; 3,473,275; and 3,482,364. These patents are relevant to the applicant's invention in that they represent the closest prior art for supporting helical staircases.

PRIOR ART STATEMENT

The aforementioned prior art, in the opinion of the applicant and the applicant's attorney, represents the closest prior art of which the applicant and the applicant's attorney are aware.

SUMMARY OF THE INVENTION

The present invention, which will be described in greater detail hereinafter, comprises a helical staircase support which includes a bracket for constructing a flying helical staircase for homes, office buildings, and the like wherein the stairway or helical staircase is supported only at lower and upper ends thereof. The bracket of the present invention includes a first vertical tube and a second vertical tube axially spaced from the first tube with a horizontal member extending between tubes affixed at one end to an upper end of the first tube and at another end to a lower end of the second tube. A plurality of brackets are assembled one to another with an upper end of the second tube of a first bracket abutting a lower end of a first tube of a second bracket and an expandable sleeve slidingly engaging the abutting tubes aligning the tubes with the sleeve expanded to rigidly affix the brackets one to another. A radius of curvature of the staircase is selectively adjustable by varying the angular alignment of the brackets one to another. Vertically oriented apertures are formed in the horizontal member to affix a plurality of stair treads to the various horizontal members using threaded fasteners which pass through the apertures and engage a lower surface of the stair tread.

It is therefore a primary object of the present invention to provide a new and improved helical stair case.

It is a further object of the present invention to provide a new and improved support for a helical staircase.

It is a further object of the present invention to provide a bracket support for a flying staircase which is attached to the dwelling only at a lower and upper end thereof.

It is yet another object of the present invention to provide a support for a flying staircase which comprises a plurality of similar brackets assembled one to another requiring only an attachment to the dwelling at an upper and lower end of the staircase.

It is a further object of the present invention to provide a bracket for constructing a helical flying staircase wherein the radius of the staircase is selectively variable and/or reversible.

For a more complete understanding of the present invention, reference is made to the following detailed description and accompanying drawings.

Other objects, advantages, and applications of the present invention will become apparent to those skilled in the field to which this invention pertains, when the accompanying description of the best modes contemplated for practicing the invention is read in conjunction with the accompanying drawings.

BRIEF DESCRIPTION OF THE DRAWINGS

In the drawings, like reference numbers refer to like parts throughout the several views, and wherein:

FIG. 1 illustrates a partial perspective view of the support for helical staircases of the present invention;

FIG. 2 illustrates an exploded broken perspective view of the bracket and riser of the present invention;

FIG. 3 illustrates an exploded view of the sleeve of the present invention;

FIG. 5 illustrates a broken perspective view of an alternate method for assemblying the brackets one to another.

DESCRIPTION OF THE PREFERRED EMBODIMENT

Figure 4:
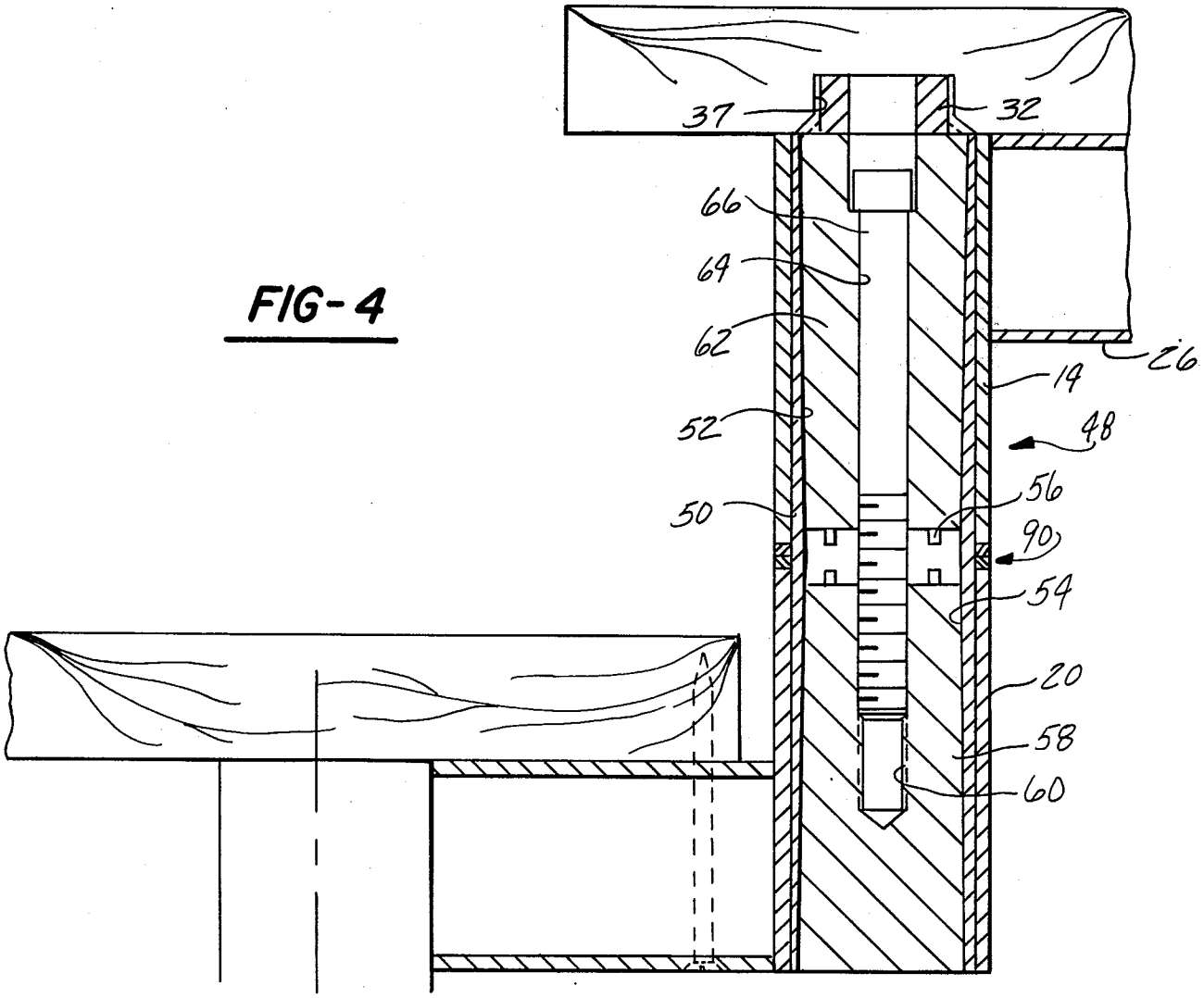
FIG. 4 illustrates a cross sectional view of the bracket of the present invention.

Referring now to the drawings and in particular to FIG. 1 wherein there is illustrated at 10 one example of the present invention in the form of a helical staircase comprising a bracket 12 which includes a first vertical tube 14 having an upper end 16 and a lower end 18. A second vertical tube 20 is axially spaced from the first tube, and includes a second vertical upper end 22 and a second vertical tube lower end 24. The second vertical tube 20 is joined to the first vertical tube 14 by a horizontal member 26 affixed at one end 28 to the first tube upper end 16 and affixed at another end 30 to the second tube lower end 24 to form an integral rigid structure.

The bracket 12 further comprises a transverse member 32 affixed the first tube upper end 16 and extending horizontally and transversely outward therefrom. The transverse member includes a plurality of vertically oriented apertures 34 distributed along the length of the transverse member 32 to receive a screw 36 which engages a lower surface of a stair tread securing the stair tread to the bracket. A recess 37 is formed along a lower surface of the tread to make the transverse member 32 hidden. Additional vertically oriented apertures 40 are formed along the horizontal member 26 to engage additional screws 36 which screws engage the lower surface of the stair tread 38 to further secure the stair tread to the bracket 12. The bracket 12 further includes a plurality of horizontally oriented apertures 42 spaced along the first 14 and the second 20 vertical tubes to receive a screw 44 to engage an inside surface of a stair riser 46 to secure the stair riser to the bracket 12. The apertures 42 may also be employed to anchor the bracket to a structural member 43 of the dwelling by a screw 45 entering the aperture 42 and engaging the member 43.

A starter plate 47 having a starter vertical tube 49 attached thereto is employed to anchor a lowermost bracket to a lower floor. Apertures 51 formed in the starter plate 47 are configured to receive a plurality of screws 53 which screws engage the floor to secure the plate. An upper end of the starter tube 49 abuts a lower end 18 of the first tube 14 to be secured to the tube 14 in a manner described hereinabove.

The support of the present invention also includes a means 48 for selectively engaging the lower end of a first tube of a second bracket 12 to the upper end of the second tube of a first bracket 12 as illustrated in FIGS. 3 and 4. The means 48 (FIG. 3) comprises an expandable sleeve 50 slidingly engaging the second tube 20 of the first bracket 12 and the first tube 14 of the second bracket 12 with the upper end of the first brackets second tube abutting the lower end of the second brackets first tube as illustrated in FIG. 4. The expandable sleeve 50 includes a pair of opposed tapered bores 52,54 formed in the sleeve 50 tapering from the ends of the sleeve inward with at least one longitudinal slit 56 formed along each taper 52,54. A first tapered plug 58 having a taper complementary to the pair of opposed tapered bores 52,54 slidingly engages the tapered bore 54 and has disposed at its center a threaded bore 60. A second tapered plug 62 having a taper complementary to the opposed tapered bores 52,54 includes a central through bore 64 and slidingly engages the tapered bore 52. A threaded fastener 66 slidingly engages the central through bore 64 and threadingly engages the threaded bore 60 wherein tightening the fastener 66 forces the tapered plugs 58,62 into the opposed tapered bores 52,54 expanding the sleeve 50 to fixedly engage the second tube of the first bracket and the first tube of the second bracket to one another.

An upper end of the staircase is anchored to the building using an upper anchor 80 (FIG. 1). An upper anchor tube 82 abuts the upper end 22 of the uppermost bracket. A cross piece 84 of planar configuration is affixed the upper anchor tube 82, and a plurality of apertures 86 formed in the cross piece 84 receive a plurality of fasteners 86 to anchor the upper anchor 80 to a building structural member. The tubes 82,20 are joined as described above.

It is obvious to the skilled artisan that a second bracket may be rotated along the axis of the abutting tubes relative a first bracket to vary the radius of the spiral staircase. Angling the second bracket to the left with respect to the first bracket produces a spiral staircase that spirals upward to the left, and conversely, angling the second bracket with respect to the first bracket to the right produces a staircase that spirals upward to the right. It is also obvious that the angle at which the second bracket is oriented to the first bracket determines the radius of curvature of the staircase. It is also obvious to the skilled artisan that a staircase having a reversing curvature may be constructed utilizing the bracket of the present invention. There is no limit to the form and shape a staircase can take. In addition to a circular form, a reversing circular form may be used as well as a curve, straight, reverse curve form. Also, a curve, straight, curve, etc. can be selected depending on the architectual needs.

Referring again to the drawings and in particular to FIG. 5, wherein there is illustrated an alternate means for assembling the brackets 12 one to another. The means illustrated in FIG. 5 comprises an engaging tube 68 fixedly attach an inside diameter of the upper end 22 of the second tube of the first bracket and projecting upward therefrom, the engaging tube 68 slidingly engages a lower end of the first tube 18 of the second bracket. A radially oriented threaded bore 70 is formed through the wall of the lower end of the second bracket first tube 18 and a threaded fastener 72 threadingly engages the threaded bore to abut the projection and fixedly secure the second bracket to the projection.

To vary the height of the staircase a plurality of shims 90 (FIG. 4) are selectively interposed the first tube 14 and the second tube 20. By selecting the number and thickness of shims 90 used the height of the assembled staircase can be matched to the distance between floors of the dwelling.

It can thus be seen that the present invention has provided a new and improved support for helical staircases wherein an economical, versatile bracket enables the user of the present invention to construct helical staircases requiring support only at a lower end and an upper end thereof. The present invention also provides the flexibility of permitting variations in the radius of the helical staircase as well as reversing curvature for the staircase.

It should be understood by those skilled in the art to which this invention pertains that other forms of the applicant's invention may be had, all coming within the spirit of the invention and scope of the appended claims.

Having thus described my invention what I claim is:

1. A helical staircase comprising:

a plurality of brackets for supporting stair treads;

each bracket including a first vertical tube having an upper end and a lower end;

a transverse member affixed the first vertical tube upper end;

a second vertical tube axially spaced from the first tube having an upper end and a lower end;

a horizontal member extending between tubes affixed at one end to the first tube upper end and affixed at another end to the second tube lower end;

a stair tread abutting said horizontal member longitudinally along a transverse central portion and abutting said transverse member; and said brackets joinable with said first tube lower end abutting said second tube upper end.

2. The stairway as defined in claim 1 further comprising:

a plurality of vertically oriented apertures formed in the transverse member with a screw entering the apertures to engage the stair tread; and a plurality of horizontally oriented apertures formed in the first and second tubes with a screw entering the apertures to engage a stair riser.

3. The stairway as defined in claim 1 further comprising:

means for selectively engaging the lower end of the first tube of a second bracket to the upper end of the second tube of a first bracket.

4. The stairway as defined in claim 3 wherein the means for selectively engaging the lower end of the first tube of the second bracket to the upper end of the second tube of the first bracket comprises:

an engaging tube fixedly attached an inside diameter of the upper end of the second tube of the first bracket and projecting upward therefrom;

a lower end of the first tube of the second bracket slidingly engaging the projection; and a radially oriented threaded bore formed in the lower end of the second bracket first tube with a threaded fastener engaging the threaded bore and abutting the projection fixedly securing the second bracket to the projection.

5. The stairway as defined in claim 3 wherein a shim means is provided for adjusting the height of said stairway support.

6. A helical staircase support comprising:

a first and a second bracket including a first vertical tube having an upper end and a lower end;

a second vertical tube axially spaced from the first tube having an upper end and a lower end;

a horizontal member extending between tubes affixed at one end to the first tube upper end and affixed at another end to the second tube lower end;

an expandable sleeve slidingly engaging the second tube of the first bracket and the first tube of the second bracket, the upper end of the first bracket second tube abutting the lower end of the second bracket first tube;

a pair of opposed tapered bores formed in the sleeve tapering from the ends of the sleeve inward;

at least one longitudinal slit formed along the tapers;

a first tapered plug complementary to the opposed tapered bores with a threaded bore at its center engaging one of the opposed tapered bores;

a second tapered plug complementary to the opposed tapered bores with a central through bore; and a threaded fastener slidingly engaging the central bore and threadingly engaging the threaded bore wherein tightening the fastener forces the tapered plugs into the opposed tapered bores expanding the sleeve to fixedly engage the second tube of the first bracket and first tube of the second bracket.

* * * * *